United States Patent [19]

Takeuchi et al.

[11] Patent Number: 4,828,015

[45] Date of Patent: May 9, 1989

[54] CONTINUOUS CASTING PROCESS FOR COMPOSITE METAL MATERIAL

[75] Inventors: Eiichi Takeuchi; Kaname Wada; Kou Miyamura; Kazuo Kanamaru; Hiroyuki Tanaka; Kazuo Sugino; Kenzo Ando, all of Kitakyushu, Japan

[73] Assignee: Nippon Steel Corporation, Tokyo, Japan

[21] Appl. No.: 107,471

[22] Filed: Oct. 9, 1987

[30] Foreign Application Priority Data

Oct. 24, 1986 [JP] Japan ..... 61-252898
Jun. 12, 1987 [JP] Japan ..... 62-145159

[51] Int. Cl.[4] ..... B22D 27/02; B22D 11/00
[52] U.S. Cl. ..... 164/461; 164/466
[58] Field of Search ..... 164/466, 461, 502, 147.1, 164/91, 94–96, 99

[56] References Cited

U.S. PATENT DOCUMENTS 3,206,808 9/1965 Robinson ..... 164/96
3,536,122 10/1970 Willim ..... 164/461
3,985,179 10/1976 Goodrich et al. .
4,567,936 2/1986 Binczewski ..... 164/453

FOREIGN PATENT DOCUMENTS 44-27361 11/1969 Japan .
49-44859 11/1974 Japan .
57-75256 5/1982 Japan ..... 164/461
57-190761 11/1982 Japan ..... 164/461
59-101261 6/1984 Japan ..... 164/466
61-193755 8/1986 Japan ..... 164/466

OTHER PUBLICATIONS

Hashimoto, Patent Abstracts of Japan, vol. 9, No. 317 (C-319) [2040], Dec. 12, 1985.

*Primary Examiner*—Kuang Y. Lin
*Attorney, Agent, or Firm*—Wenderoth, Lind & Ponack

[57] ABSTRACT

A method of producing a composite metal material such as clad bloom by continuous casting comprises the steps of supplying molten metals of different compositions by using two immersion nozzles into the strand pool at different positions and forming a static magnetic field zone on the boundary between the two types of metals to prevent mixing of the metals of different composition. The method enables production of a composite material exhibiting a sharp boundary between the two types of metals used and enables the thickness of the respective metal layers to be easily controlled by adjusting the location of application of the static magnetic field or the withdrawal speed of the strand of cast metal.

8 Claims, 7 Drawing Sheets

CONTINUOUS CASTING PROCESS FOR COMPOSITE METAL MATERIAL

BACKGROUND OF THE INVENTION

1.Field of the Invention

This invention relates to a method of producing a composite metal material, typically a clad steel bloom or slab, comprising outer and inner layers of different compositions, namely of different chemical compositions, and more particularly to such a method wherein the composite metal material is produced by continuous casting.

2. Description of the Prior Art

As methods of producing clad steel materials there are generally known the cast coating method, the explosive bonding method, the rolling pressure bonding method and the overlay welding method.

In the cast coating method, an ingot for the core material is placed in a mold and molten steel of a composition different from that of the ingot is poured into the mold and allowed to solidify, thus producing a clad ingot. Because of its simplicity, this method has been used extensively at steelworks.

However, with the rapid spread of methods for the continuous casting of steel, which are advantageous in terms of production cost, yield and quality, conventional ingoting methods are falling into disuse. This has created a need for methods for producing clad steel materials using continuous casting techniques, and, in fact, a number of such methods have been proposed.

For example, one such method is disclosed in Japanese Patent Publication 44(1969)-27361. In the disclosed method, two immersion nozzles of differing length are inserted into the pool of molten metal in the mold, the outlets of the two nozzles are located at different positions with respect to the direction of casting, and different types of molten metal are poured through the respective nozzles (see FIG. 3 of the present drawings).

In FIG. 3, reference numeral 11 denotes the mold, while 12 and 13 denote the nozzles. The nozzles 12 and 13 are of different length and are used to pour different metals into the mold 11. Reference numeral 14 denotes the pool of molten metal in the mold 11, 15 denotes the outer layer of the composite material and 16 denotes the solidified portion of the inner layer thereof.

In a method that relies solely on using two immersion nozzles for pouring different metals into the mold at different positions, however, regardless of what attempt is made to control the positions at which the different metals are poured into the mold or to control the pattern of the flow of the poured metals, intermixing of the metals will occur between the molten metals in the course of the pouring operation, that is to say, in the course of the continuous casting operation. As a result, the concentration from the outer layer inward of the strand being cast will become uniform in the thickness direction, or the boundary between the outer and inner layers will become extremely indefinite, making it impossible to obtain a composite steel material with the desired sharply defined boundary between the outer and inner layers.

A solution to this problem is proposed in Japanese Patent Publication 49(1974)-44859 wherein, as shown in FIG. 2 of the present drawings, the continuous casting process is carried out using a partition made of refractory material disposed in the mold between the different types of metal In FIG. 2, reference numeral 21 denotes the mold, and 22 and 23 denote immersion nozzles having different lengths and introducing different metals into the mold 21. Reference numeral 24 denotes a pool of molten metal in the mold 21, 25 denotes the outer layer of a composite steel material, 26 denotes the solidified portion of an inner layer thereof, and 27 denotes a refractory partition.

When a refractory partition of a size large enough to restrict mixing of the different molten metals is introduced into the molten metal pool of the continuous casting strand (the strand pool), however, a major problem arises in connection with the casting operation. More specifically, when the refractory partition comes in contact with the solidifying shell, there is a high risk of its catching on the shell, and as a result a danger either of breaking the refractory partition or of breaking the shell and allowing the molten metal to flow to the exterior of the strand in what is called a "breakout."

Moreover, where the refractory partition in the mold remains immersed in a high-temperature molten metal such as molten steel, problems are apt to arise in connection with its physical strength. Specifically, it is likely to suffer fusion damage or breakage, in which case not only will it become impossible for the refractory partition to fulfill its original purpose but there will also arise serious problems regarding the casting operation and the quality of the product as a result of entrainment of the refractory material in the strand.

SUMMARY OF THE INVENTION

The object of the present invention is to provide a method which eliminates the aforesaid problems of the prior art and enables continuous casting of excellent quality composite metal material under stable operating conditions.

In a method of producing composite metal material by continuous casting, the present invention provides a continuous casting method characterized in that molten metal is partitioned by a static magnetic field and each partitioned region is supplied with molten metal of a different composition.

As typical embodiments of the method of partitioning the molten metal using a static magnetic field there can be mentioned the following (A) and (B).

(A) The method of continuous casting a composite metal material wherein a static magnetic field is formed below the level of the meniscus of the molten metal by a distance l determined in accordance with the following equation (1) such that magnetic lines of force extend across the full width of the strand of cast metal perpendicularly to the direction of casting.

$$l = \frac{dv}{f} \tag{1}$$

where l is the distance in meters from the level of the molten metal surface, d is the thickness in meters of the metal which is to constitute the outer layer, v is the withdrawal speed of the strand of cast metal in meters per minute, and f is the mean solidification rate of shell solidified from the cast surface to the thickness d in meters per minute.

(B) A method of continuously producing a clad cast steel material wherein the interior of a mold for continuous casting is partitioned by a static magnetic field produced by a direct-current electromagnet or a permanent magnet whose S and N poles are positioned on the outer surfaces at opposite sides of the mold so as to extend in the direction of casting, and molten steels of different compositions are poured into the respective partitioned regions through immersion nozzles.

The embodiments (A) and (B) will now be described in detail with respect to the drawings.

While the ensuing description of embodiments of the invention will be made primarily in respect of composite steel materials, it should be understood that the invention can similarly be applied to metal materials other than steel.

DESCRIPTION OF THE PREFERRED EMBODIMENTS

First we will describe the embodiment (A) hereinafter.

In order to provide a fundamental solution to the problems of the prior art, in embodiment (A) of the invention the molten metals of different composition within the strand pool are separated by magnetic means and molten metals of different composition are to supplied to upper and lower regions which are separated by a magnetic field. In this way it is possible to obtain a composite metal material wherein there is a sharp boundary between the metal of the upper region of the strand pool (the metal which comes to constitute the outer layer of the strand after solidification) which solidifies first and the metal of the lower region (the metal which comes to constitute the inner layer of the strand after solidification) which solidifies thereafter, i.e. wherein the concentration transition layer between the said two layers is thin.

The inventors carried out various studies in order to find a solution to the problems of the prior art. As a result, they discovered that by forming a static magnetic field zone between the position at which molten metal is supplied to a relatively upward region of the mold and the position at which molten metal is supplied to a relatively downward region of the mold, so that magnetic flux will extend perpendicularly to the direction of casting, the mixing of metals of different composition supplied at different positions can be effectively prevented.

This invention was accomplished on the basis of this discovery.

Figure 1A:
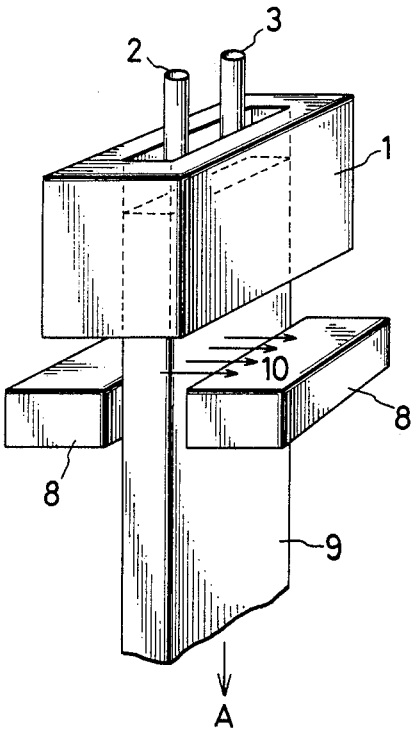
FIGS. 1(*a*) and 1(*b*) are respectively a perspective view and a sectional view showing an apparatus for carrying out one embodiment (A) of the method of the present invention.
Figure 1B:
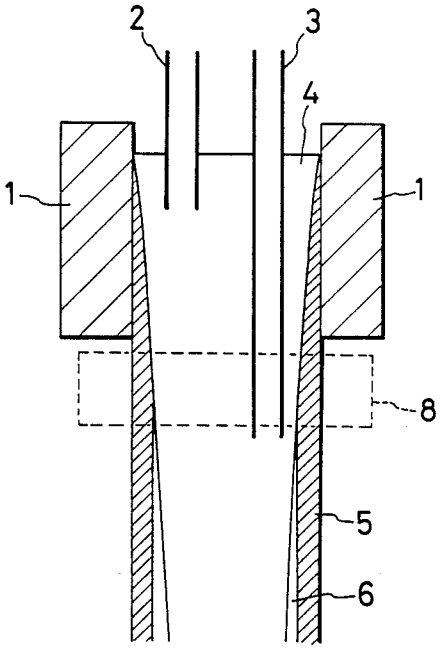
Figure 2:
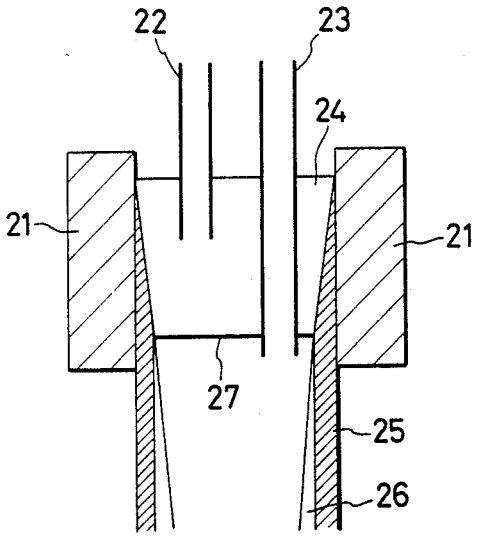
FIG. 2 PRIOR ART
FIG. 2 is a sectional view of an apparatus for carrying out a conventional method in which mixing of molten metals of different compositions is inhibited by the presence of a refractory partition.
Figure 3:
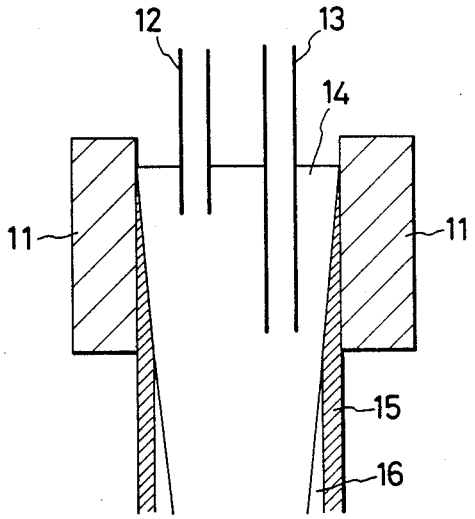
FIG. 3 PRIOR ART
FIG. 3 is a sectional view of an apparatus for carrying out a conventional method in which two immersion nozzles are used for pouring molten metals of different compositions into a molten metal pool within a mold at different positions relative to the direction of casting.

One example of an apparatus for carrying out the embodiment (A) is illustrated in FIGS. 1(*a*) and 1(*b*).

In these figures, the reference numeral 1 denotes a mold, and 2 and 3 denote respective immersion nozzles of different length used for pouring molten metals of different composition into the mold 1. Reference numeral 4 denotes a molten metal pool, 5 denotes the outer layer of a composite steel material, and 6 denotes the solidified portion of an inner layer of the composite steel material. The reference numeral 8 denotes a magnet for producing a static magnetic field such that magnetic lines of force 10 extend perpendicularly to the direction of casting (A). The strand of cast metal is indicated at 9.

The manner of determining the position relative to the direction of casting at which to produce the static magnetic field will now be explained. For obtaining a prescribed value for the thickness d of the metal layer constituting the outer layer of the strand, the relationship among the distance l from the meniscus level of the molten metal within the mold, the mean solidification rate f of the cast metal, and the withdrawal speed v of the strand are adjusted to satisfy the following equation $$l = \frac{dv}{f} \tag{1}$$

A static magnetic field of predetermined strength is formed at a position below the level of the molten metal surface by the so-determined distance l so as to extend across the full width of the cast metal and to extend in the direction of casting by a predetermined width, thereby to produce magnetic flux perpendicular to the direction of casting. The flow of molten metal which tends to be caused within the pool of molten metal by the pouring operation is restricted at this portion by the static magnetic field so that mixing of the upper and lower molten metal region which contact at this position can be minimized.

The suppression of the flow velocity of the molten metal increases in proportion as the density of magnetic flux in increased, and the density of magnetic flux of the static magnetic field should be made as high as possible within the range that it does not hinder the casting operation. This restriction also increases in proportion as the width of the static magnetic field in the direction of casting is increased. However, it must be kept in mind that the static magnetic field zone may in some cases constitute a transition layer between the upper and lower regions so that from this point of view, the width of the static magnetic field zone in the direction of casting should be made as small as possible.

It has long been known that the flow velocity of a conductive fluid is reduced when it moves through a magnetic field. This invention relates to a production process in which such a "braking" effect is applied at a specified position in the direction of casting. More particularly, it relates to a method of producing a composite steel material by supplying molten metals of different composition above and below the specified position for establishing the braking effect and further permits the thickness of the outer layer of the composite steel material to be controlled by selecting the aforesaid specified position. For producing the static magnetic field it is possible to use either an electromagnet or a permanent magnet.

For inhibiting the mixing of the molten metals of different composition, the effect produced by the static magnetic field has to be accompanied by control of the amount of the poured metals in accordance with the amount of solidification thereof in the upper and lower regions of the strand pool. More specifically, in the case where mixing of the two layers is inhibited by application of the static magnetic field while at the same time the pouring ratio between the two types of molten metals is varied, there will invariably be some mixing at the boundary region even when the variation takes place with the boundary between the two types of molten metal within the static magnetic field zone. Moreover, in the case where the boundary shifts outside the static magnetic field zone, little or no inhibition of mixing can be expected. What is more, the variation of the pouring ratio itself sometimes promotes mixing of the metals.

As an alternative method, the inventors further confirmed that instead of supplying molten metal to both the upper and lower parts of the metal pool it is also effective to add an alloy component in the form of wire to the molten metal in one or the other of the partitioned regions, thereby to create a layer with a high concentration of the alloying component at the region where the addition is made, and to inhibit the mixing of the metals of the upper and lower regions by the static magnetic field zone. When the wire is to be added to the lower region, it is effective to use coated wire in order to prevent the wire from dissolving into the upper region.

Figure 8:
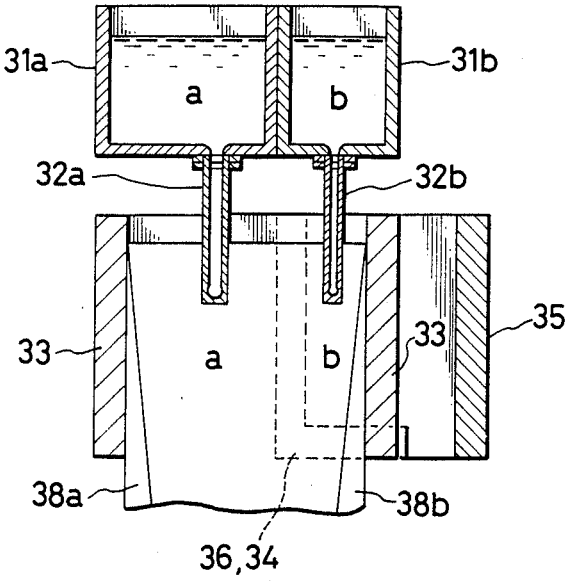
FIG. 8 is a vertical sectional view of an apparatus for carrying out one embodiment (B) of the invention.
Figure 9:
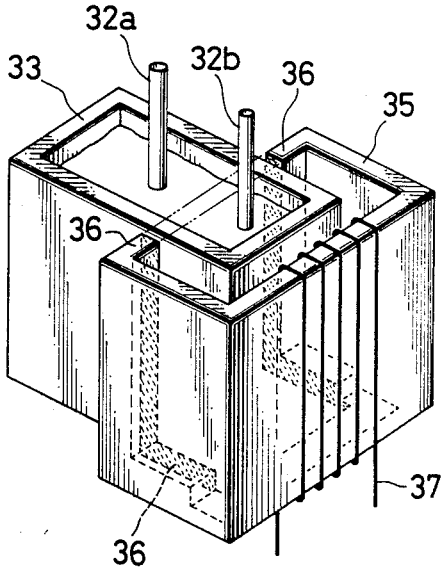
FIG. 9 is a partial perspective view of the apparatus shown in FIG. 8.

The method of continuously casting clad steel according to the embodiment (B) will now be explained with respect to FIGS. 8 and 9. FIG. 8 is a vertical sectional view showing a device for carrying out the embodiment (B), while FIG. 9 is a partial perspective view of the same.

The basic principle of the present invention is that of preventing the mixing of different types of molten steel by the magnetic force of a static magnetic field. Referring to the drawings, L-shaped poles 36 of a magnet 35, which may be either a direct-current electromagnet or a permanent magnet, are disposed on the exterior of the sides with greater width of a mold 33 as displaced in the direction of one of the sides with shorter width. The regions into which the interior of the mold is divided by the static magnetic field produced by the magnet are simultaneously supplied through nozzles **32*a* and 32*b* with molten metals a and b of different compositions from tundishes 31*a* and 31*b***.

As the magnetic poles are L-shaped, mixing of the molten metals a and b can be completely prevented. By subdividing the mold 33 by L-shaped magnetic poles as shown in FIGS. 8 and 9, the molten metal b, for example, is sealed within a divided-off region. In this state, the molten metal b solidifies inwardly from the wall of the mold 33, forming a solidified shell as indicated by the slanted line in FIG. 10.

On the other hand, since the remaining unsolidified portion of the molten steel b is sealed in the divided-off region by the magnetic poles 36, the continuous casting proceeds with the molten metal a being positively supplied into the area under this divided-off region so that, advantageously, it is possible to produce a clad cast steel material that exhibits only a very slight mixed region.

Alternatively, the magnetic poles can instead be disposed vertically (in the shape of an I), with considerably good effect.

It is necessary to adjust the pouring rates of the molten metals a and b so that the balance therebetween will be appropriate in light of the ratio between the volumes of the regions into which the mold is divided by the static magnetic field. This is because mixing of the molten metals a and b is promoted when an imbalance arises between the pouring rates thereof.

It is further necessary to appropriately determine the directions in which the discharge orifices of the immersion nozzles **32*a* and 32*b*** face so as to prevent the discharged streams of molten metal from impinging directly with the static magnetic field.

The techniques outlined in the foregoing enable the magnetic force produced by the static magnetic field to effectively prevent mixing of the two types of molten metal. While the effect of the static magnetic field becomes higher in proportion as its strength increases, a practical strength thereof will be in the range of about 2,000 to 8,000 gauss, the actual strength used being determined with consideration to the casting conditions.

Figure 10:
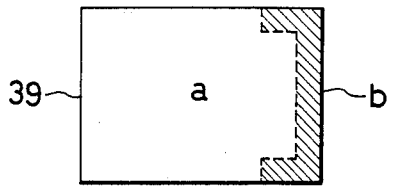
FIG. 10 is a cross-sectional view of a single-sided clad steel bloom produced by the method of this invention.

Thus, as shown in FIG. 10, there was obtained a single-sided clad steel strand constituted overwhelmingly of the metal a and clad only on one of its shorter width sides with a layer of the metal b.

Moreover, it should be noted that the method just described can be carried out on both sides of the strand to obtain a double-sided clad steel strand.

In the embodiment (B) described, L-shaped magnetic poles are disposed on the exterior of the sides of the mold having greater width. The invention is not limited to this arrangement, however, and it is alternatively possible to provide the magnetic poles on the exterior of the sides of the mold having smaller width.

EXAMPLE 1 (EXAMPLE OF EMBODIMENT A)

Molten 18% Cr - 8% Ni stainless steel of the composition indicated at ① in Table 1 and molten ordinary carbon steel of the composition indicated at ② were retained in separate tundishes and poured through separate nozzles into the upper and lower regions of a strand pool for continuous casting, respectively.

TABLE 1

| | C | Mn | Si | Cr | Ni | P | S |
|---|---|---|---|---|---|---|---|
| ① | 0.04 | 1.50 | 0.70 | 18.10 | 8.50 | 0.010 | 0.012 |
| ② | 0.15 | 1.0 | 0.25 | 0 | 0 | 0.015 | 0.010 |

The mold measured 250 mm in depth and 1,000 mm in width and the casting speed was 1 m/min. In the case of this casting speed of 1 m/min, the solidification thickness d is obtained from the following equation $$d = 20\sqrt{t}\ (\text{mm}) \tag{2}$$

Hence the mean solidification rate f is expressed as equation (3).

$$f = \frac{20}{\sqrt{t}} \tag{3}$$

In producing the composite steel material consisting of the outer 18% Cr - 8% Ni stainless steel layer and the inner layer of ordinary carbon steel, the thickness of the outer layer was set at 20 mm. Thus, by the equations (1)~(3), it was found that l=1 m. Therefore, a uniform static magnetic field was applied across the width of the cast metal so as to have its vertical center at 1 m below the meniscus level and to extend vertically over a zone from 10 cm above to 10 cm below this center. The magnetic flux density was 5,000 gauss. The discharge hole of the immersion nozzle for pouring the molten stainless steel for the outer layer was located about 100 mm below the meniscus level of the molten steel, while the discharge hole of the immersion nozzle for pouring the molten ordinary carbon steel was located immediately beneath the static magnetized field zone. A direct-current static magnetic field was applied during the first 10 m of casting, whereafter casting was carried out without application of a static magnetic field. After completion of the casting operation, samples were cut from the strand at typical normal portions thereof, and the sample cross-sections were examined.

Figure 4A:
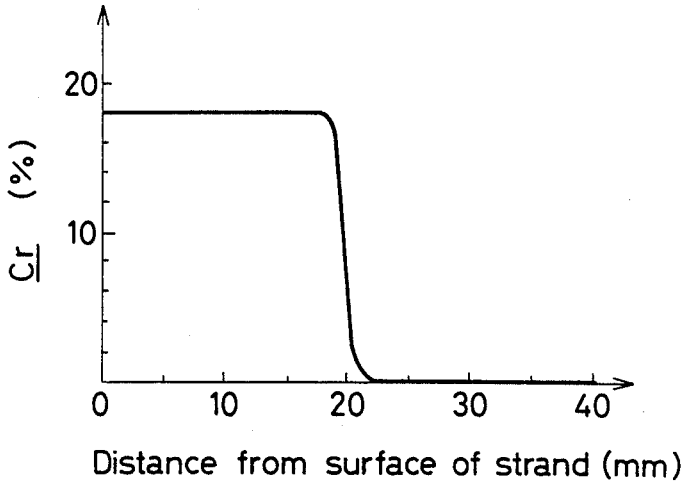
FIGS. 4(*a*) and 4(*b*) are graphs showing the distribution of Cr concentrations within the outer layers of continuously cast strands.
Figure 4B:
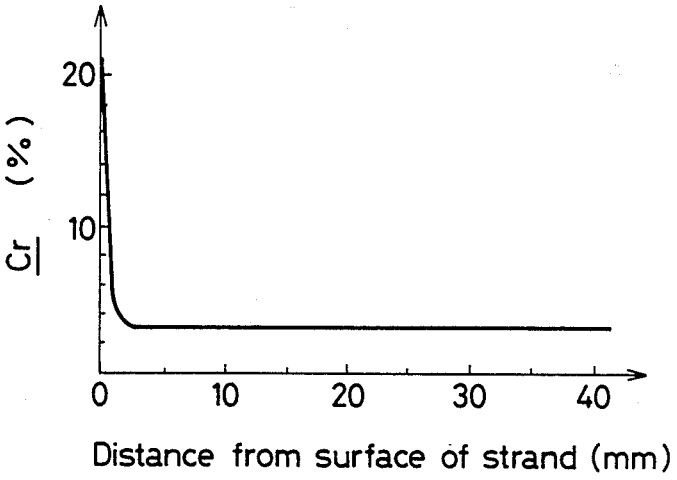

FIG. 4(*a*) shows the distribution of Cr concentration for a sample (a) produced using a static magnetic field while FIG. 4(*b*) shows the same for a sample (b) produced without use of a static magnetic field. The sample (a) had a 20 mm outer layer formed of the stainless steel component and the transition layer between this layer and the inner layer formed of the ordinary carbon steel component was extremely thin. In contrast, in the sample (b), although the Cr concentration was high at the surface, it rapidly decreased with increasing depth, showing that the two types of metals mixed within the molten metal pool during casting.

EXAMPLE 2 (EXAMPLE OF EMBODIMENT A)

Molten semi-deoxidized Al killed steel of the composition indicated at ① and rimmed steel of the composition indicated at ② in Table 2 were retained in separate tundishes and poured through separate nozzles into the upper and lower regions of a strand pool for continuous casting, respectively.

TABLE 2

| | C | Mn | Si | P | S | Al | N | free O |
|---|---|---|---|---|---|---|---|---|
| ① | 0.03 | 0.15 | 0.01 | 0.010 | 0.015 | 0.005 | 25 ppm | 40 ppm |
| ② | 0.04 | 0.12 | 0.01 | 0.013 | 0.012 | 0.002 | 20 ppm | 100 ppm |

The mold measured 250 mm in depth and 1,000 mm in width and the casting speed was 1 m/min. In the case of this casting speed of 1 m/min, the solidification thickness d is obtained from the following equation $$d = 20\sqrt{t}\ (\text{mm}) \tag{2}$$

Hence the mean soldification rate f is expressed as equation (3).

$$f = \frac{20}{\sqrt{t}} \tag{3}$$

In producing the composite steel material consisting of the outer semi-deoxidized Al killed steel layer and the inner layer of rimmed steel, the thickness of the outer layer was set at 20 mm. Thus, by the equations (1)~(3), it was found that l=1 m. Therefore, a uniform static magnetic field was applied across the width of the cast metal so as to have its vertical center at 1 m below the level of the molten metal surface and to extend vertically over a zone from 10 cm above to 10 cm below this center. The magnetic flux density was 3,000 gauss. The discharge hole of the immersion nozzle for pouring the molten semi-oxidized Al killed steel for the outer layer was located about 100 mm below the level of the molten metal surface, while the discharge hole of the immersion nozzle for pouring the molten rimmed steel was located immediately beneath the static magnetized field zone. A direct-current static magetic field was applied during the first 10 m of casting, whereafter casting was carried out without application of a static magnetic field. After completion of the casting operation, samples were cut from the strand at typical normal portions thereof, and the sample cross-sections were examined.

Figure 5A:
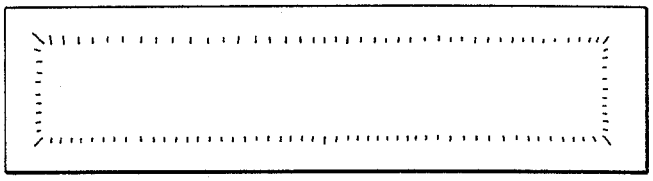
FIGS. 5(*a*) and 5(*b*) are sectional views of samples of composite metal materials produced according to Example 2.
Figure 5B:
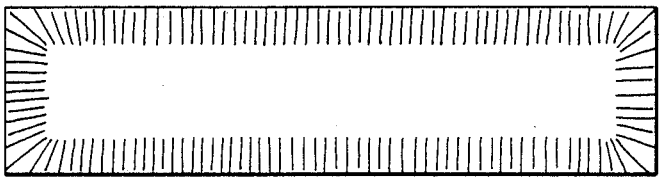

FIG. 5(*a*) shows the distribution of CO blowholes for a sample (a) produced using a static magnetic field while FIG. 5(*b*) shows the same for a sample (b) produced without use of a static magnetic field. The inventors made an investigation to determine the limit of free oxygen (free O) concentration beyond which CO blowholes form when steel of this composition is used and discovered that needle-shaped CO blowholes form at the surface of the strand when the concentration of free O exceeds 50 ppm. In sample (a) shown n FIG. 5(*a*), a solidified outer layer of steel type ① extends into the strand to a depth of 20 mm. The free O concentration in this layer was 40 ppm and, as a result, absolutely no CO blowholes were formed. CO blowholes formed inward of this outer layer as a result of the solidification of the steel type ②. However, since the solidification of the inner layer started one meter below the metal meniscus, where it was affected by the corresponding static pressure of the molten steel acting at this depth, the formation of the CO blowholes stopped at a depth of 25 mm from the surface. On the other hand, in the sample (b) shown in FIG. 5(*b*), since no static magnetic field was applied, the two types of steel mixed. As a result, the free O concentration exceeded 50 ppm and CO blowholes formed at the surface of the strand.

Generally speaking, when a strand having blowholes formed at the surface by CO gas or the like is rolled, the blowholes remain as flaws in the surface of the rolled strand. Such cavities are thus a major problem in production.

In this Example, absolutely no CO blowholes formed in the outer layer of the strand produced in accordance with this invention. The invention thus enables the production by continuous casting of a satisfactory strand with high free oxygen concentrations, such as has heretofore been impossible to produce by continuous casting because of the occurrence of CO blowholes.

EXAMPLE 3 (EXAMPLE OF EMBODIMENT A)

Molten medium carbon steel of the composition indicated at ① and molten high carbon steel of the composition indicated at ② in Table 3 were retained in separate tundishes and poured through separate nozzles into the upper and lower regions of the molten metal pool for continuous casting.

TABLE 3

| | C | Si | Mn | P | S | Al |
|---|---|---|---|---|---|---|
| ① | 0.21 | 0.32 | 0.38 | 0.017 | 0.022 | 0.061 |
| ② | 0.46 | 0.35 | 0.41 | 0.015 | 0.017 | 0.052 |

The mold measured 250 mm in depth and 1,000 mm in width and the casting speed was 1 m/min. In the case of this casting speed of 1 m/min, the solidification thickness d is obtained from the following equation $$d = 20\sqrt{t}\ (\text{mm}) \tag{2}$$

Hence the means solidification rate f is expressed as equation (3).

$$f = \frac{20}{\sqrt{t}} \tag{3}$$

Figure 6:
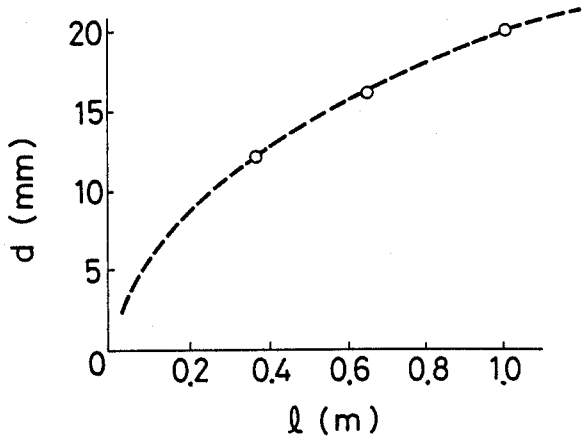
FIG. 6 is a graph showing the relation between the thickness d of an outer layer and a distance l from the level of the molten metal surface.

The distances 1 required for obtaining outer layers with thicknesses of 12 mm, 16 mm and 20 mm were found by the equation (1)~(3) to be (a) 0.36 m, (b) 0.64 m and (c) 1.0 m, respectively. In three separate continuous casting operations, a uniform static magnetic field was applied across the width of the cast metal so as to have its vertical center at 0.36 m, 0.64 m and 1.0 m below the level of the molten metal surface and to extend vertically over a zone from 10 cm above to 10 cm below this center. The magnetic flux density was 3,000 gauss. The discharge hole of the immersion nozzle for pouring the molten steel of type ① for the outer layer was located about 100 mm below the level of the molten metal surface, while the discharge hole of the immersion nozzle for pouring the molten steel of the type ② for the inner layer was located immediately beneath the static magnetized field zone. After completion of the casting operations, samples were cut from the so-obtained strands (a), (b) and (c) at typical normal portions thereof, and the mean thicknesses of the outer layers were determined. The results are shown in the graph of FIG. 6. It was thus demonstrated that by the method of the present invention it is possible in the manner of this Example to control the thickness of the cladding layer of the clad steel material.

EXAMPLE 4 (EXAMPLE OF EMBODIMENT A)

Molten medium carbon steel of the composition indicated at ① and molten high carbon steel of the composition indicated at ② in Table 4 were retained in separate tundishes and poured through separate nozzles into the upper and lower regions of the molten metal pool for continuous casting.

TABLE 4

| | C | Si | Mn | P | S | Al |
|---|---|---|---|---|---|---|
| ① | 0.18 | 0.30 | 0.39 | 0.020 | 0.021 | 0.055 |
| ② | 0.45 | 0.34 | 0.45 | 0.023 | 0.015 | 0.049 |

The uniform magnetic field was applied so as to have its vertical center at 1 m below the level of the molten metal surface and to extend vertically over a zone from 10 cm above to 10 cm below this center. The magnetic flux density was 3000 gauss.

The mold measured 250 mm in depth and 1,000 mm in width and the casting speed was 1 m/min. In the case of this casting speed of 1 ~2 m/min, the solidification thickness d is obtained from the following equation $$d = 20\sqrt{t}\ (\text{mm}) \tag{2}$$

As a result the solidification rate f is expressed as equation (4).

$$f = \frac{20}{\sqrt{1/v}} \tag{4}$$

Figure 7:
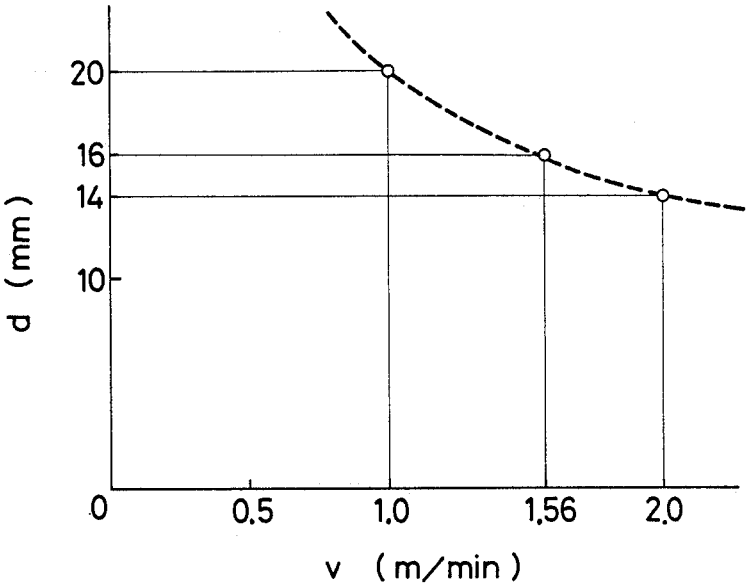
FIG. 7 is a graph showing the relation between the thickness d of the outer layer and the strand withdrawal speed v.

The values of v required for obtaining outer layers with thicknesses of 14 mm, 16 mm and 20 mm were calculated from equations (1) and (4) and found to be (a) 2 m/min, (b) 1.56 m/min and (c) 1 m/min. The discharge hole of the immersion nozzle for pouring the molten steel of type ① for the outer layer was located about 100 mm below the level of the molten metal surface, while the discharge hole of the immersion nozzle for pouring the molten steel of the type for the inner layer was located immediately beneath the static magnetized field zone. After completion of three separate casting operations, samples were cut from the so-obtained strands (a), (b) and (c) at typical normal portions thereof, and the mean thickness of the outer layers were determined. The results are shown in the graph of FIG. 7. It was thus demonstrated that by the method of the present invention it is possible in the manner of this Example to control the thickness of the cladding layer of the clad steel material.

EXAMPLE 5 (EXAMPLE OF EMBODIMENT B)

Using the apparatus illustrated in FIG. 8, continuous casting of clad steel was conducted at a casting speed of 0.8 m/min for producing a 300×400 mm² bloom for rail production. As the molten steel a to be charged into the tundish 31*a* there was used a high carbon steel (about 0.8 wt % C) of the composition ordinarily used as a rail material, and as the molten steel b to be charged into the tundish 31*b* there was used a low carbon steel (about 0.3% C) which was a rail material with only its carbon content made low. The opening/closing degrees of the tundish nozzles were adjusted to simultaneously pour the molten steel a at 690 kg/min and the molten metal b at 60 kg/min. The nozzles were of the three-hole immersion type.

When tests were conducted by varying the strength of the magnetic field produced by the direct-current electromagnet 35, it was found that mixing of the molten metals a and b was totally prevented under application of a magnetic field of about 4,000 gauss. Under these conditions, there was obtained a single-sided clad steel bloom such as shown in FIG. 10 which had a 20 mm-thick layer containing about 0.3 wt % C along one of its narrower sides, the remainder of the bloom being constituted of steel with a C content of about 0.8 wt %.

Figure 11:
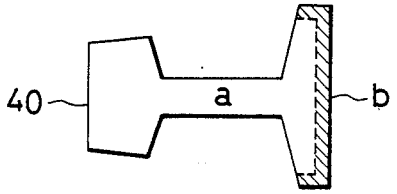
FIG. 11 is a cross-sectional view of a clad steel rail wherein only the bottom portion is made of low-carbon steel.

This bloom was rolled to obtain a clad rail which, as illustrated in FIG. 11, was constituted predominately of high carbon steel a and had only its base portion formed of the low carbon steel b.

Figure 12:
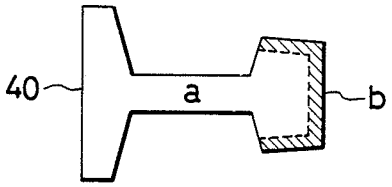
FIG. 12 is a cross-sectional view of a clad steel rail wherein the rail head is made of high-carbon steel and the remainder is made of low-carbon steel.

On the other hand, where, oppositely from the above, a high carbon steel (about 0.8 wt % C) of the composition ordinarily used as a rail material is used as the molten steel b and a low carbon steel (about 0.3% C) which is a rail material with only its carbon content made low is used as the molten metal a and clad steel bloom is produced using the continuous casting method of this invention, there can be obtained a clad steel rail in which, as shown in FIG. 12, only the head of the rail is formed of high carbon steel and the remainder thereof is formed of low carbon steel.

Thus, by the aforesaid methods it becomes possible to obtain a clad steel rail wherein only the head portion requiring high resistance to wear is formed of high carbon steel and the remaining portions, particularly the base, are formed of low carbon steel. This is advantageous in that it makes it possible to overcome a problem that is common in the conventional high carbon steel rail. Namely, in the conventional high carbon steel rail, white phase (martensite texture) is apt to develop in scratches occurring on the bottom of the rail during transport and the scratches in which the martensite develops are apt to become starting points for rail breakage. In the case of a rail produced according to the present invention, however, the bottom of the rail can be made of low carbon steel, thus preventing the occurrence of white phase and making it possible to provide a low-cost rail that has good resistance to breakage.

As explained in the foregoing, the method of the present invention uses a static magnetic field to divide the strand pool into separate regions which are supplied with molten metals of different composition, thus minimizing mixing of the metals in the course of continuous casting, whereby it becomes readily possible by continuous casting to produce a composite metal material having a sharply defined boundary between its two layers.

Moreover, the magnetic field can be produced to extend vertically through the interior of the continuous casting mold so as to prevent the mixing of molten metals of different compositions poured into the mold on opposite sides thereof, whereby it becomes possible to produce singlesided clad metal strand of various types.

The method of this invention can also be applied for production of a clad steel rail having its head portion formed of the conventional high carbon steel and the base thereof formed of low carbon steel. Such a rail exhibits extremely high resistance to breakage.

What is claimed is:

1. A method of continuously casting a composite metal material comprising the steps of dividing molten metal into regions by use of a static magnetic field such that the static magnetic field is positioned between the divided regions, and supplying molten metals of different compositions to the respective divided regions.

2. The method of continuously casting a composite metal material as claimed in claim 1 wherein said material has outer and inner layers of different compositions and the static magnetic field is formed below the level of the surface of the molten metal by a distance l determined in accordance with following equation (1) such that magnetic lines of force extend across the full width of the strand of cast metal perpendicularly to the direction of casting and divide the molten metal into upper and lower regions, and molten metals of different compositions are supplied to the respective divided regions by controlling the amounts of the metals poured into the respective divided regions so that any variation of pouring ratio between the two types of molten metals is minimized, $$l = \frac{dv}{f} \quad (1)$$

where l is the distance in meters from the level of the molten metal surface, d is the thickness in meters of the metal which is to constitute the outer layer, v is the withdrawal speed of the strand of cast metal in meters per minute, and f is the mean solidification rate from the surface to the thickness d of the strand in meters per minute.

3. The method of continuously casting a composite metal material as claimed in claim 2 wherein the molten metals of diferent compositions are supplied to the respective divided regions by means of immersion nozzles.

4. The method of continuously casting a composite metal material as claimed in claim 1 wherein the static magnetic field is formed below the level of the surface of the molten metal by a distance l determined in accordance with following equation (1) such that magnetic lines of force extend across the full width of the strand of cast metal perpendicularly to the direction of casting, $$l = \frac{dv}{f} \quad (1)$$

where l is the distance in meters from the level of the molten metal surface, d is the thickness in meters of the metal which is to constitute the outer layer, v is the withdrawal speed of the strand of cast metal in meters per minute, and f is the means solidification rate of the strand in meters per minute.

5. The method of continuously casting a composite metal material as claimed in claim 4 wherein wire or metal-coated wire is supplied as an alloying component to the molten metal above the magnetic field of the molten metal below the magnetic field.

6. The method of continuously casting a composite metal material as claimed in claim 1 wherein the width of a strand pool for continuous casting is divided by the static magnetic field and molten metals of different compositions are supplied to the respective divided regions through respective immersion nozzles.

7. A method of continuously casting a composite metal material as claimed in claim 6 wherein a region of a strand pool for continuous casting is divided off from a remaining region by the static magnetic field and the composition of molten metal supplied to each of said regions is controlled by supplying wire or metal-coated wire thereto.

8. A method of continuously casting a composite metal material as claimed in claim 6 wherein the interior of a mold for continuous casting is partitioned by a static magnetic field produced by a direct-current electromagnet or a permanent magnet whose S and N poles are positioned on the outer surfaces at opposite sides of the mold so as to extend in the direction of casting and molten steels of different compositions are poured into the respective partitioned regions through respective immersion nozzles.

* * * * *